United States Patent [19]

Jones

[11] 4,181,166

[45] Jan. 1, 1980

[54] WOOD SPLITTING IMPLEMENT

[76] Inventor: Dale A. Jones, Rte. 1, Palmetto, Ga. 30268

[21] Appl. No.: 763,534

[22] Filed: Jan. 28, 1977

[51] Int. Cl.[2] ..... B26B 23/00
[52] U.S. Cl. ..... 145/2 R
[58] Field of Search ..... 145/2 R, 3

[56] References Cited

U.S. PATENT DOCUMENTS

| | | | |
|---|---|---|---|
| 261,338 | 7/1882 | Grellner | 145/29 R |
| 303,766 | 8/1884 | Trenor | 145/2 R |
| 838,405 | 12/1906 | Henkel | 145/2 R |
| 1,280,465 | 10/1918 | Herron | 145/2 R |
| 1,729,365 | 9/1929 | Sells | 145/2 R |
| 3,219,316 | 11/1965 | Fried | 145/2 R |

FOREIGN PATENT DOCUMENTS

| | | | |
|---|---|---|---|
| 33586 | 11/1885 | Fed. Rep. of Germany | 145/2 R |
| 232704 | 9/1944 | Switzerland | 145/2 R |
| 8638 | of 1890 | United Kingdom | 145/2 R |

*Primary Examiner*—R. L. Spruill
*Assistant Examiner*—J. T. Zatarga

[57] ABSTRACT

A wood splitting implement adapted to be manually swung to split tree blocks into firewood including a handle with a gripping section and a head carrying section; and a splitting head with an eye section mounted on the head carrying section of the handle and a parallel edged splitting blade on the eye section. The splitting head may have a cross edged blade on the eye section in opposition to the parallel edged splitting blade and a catch member to prevent the wood from being thrown toward the user when the cross edged splitting blade is being used.

5 Claims, 13 Drawing Figures

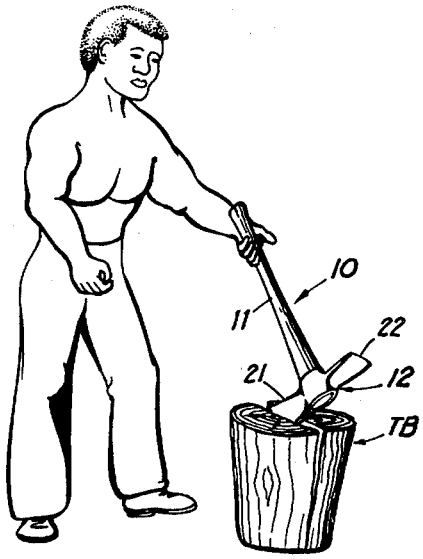
FIG 1
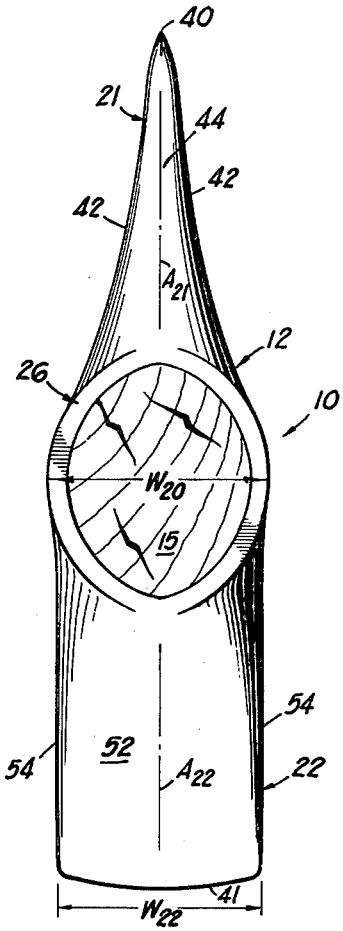
FIG 3
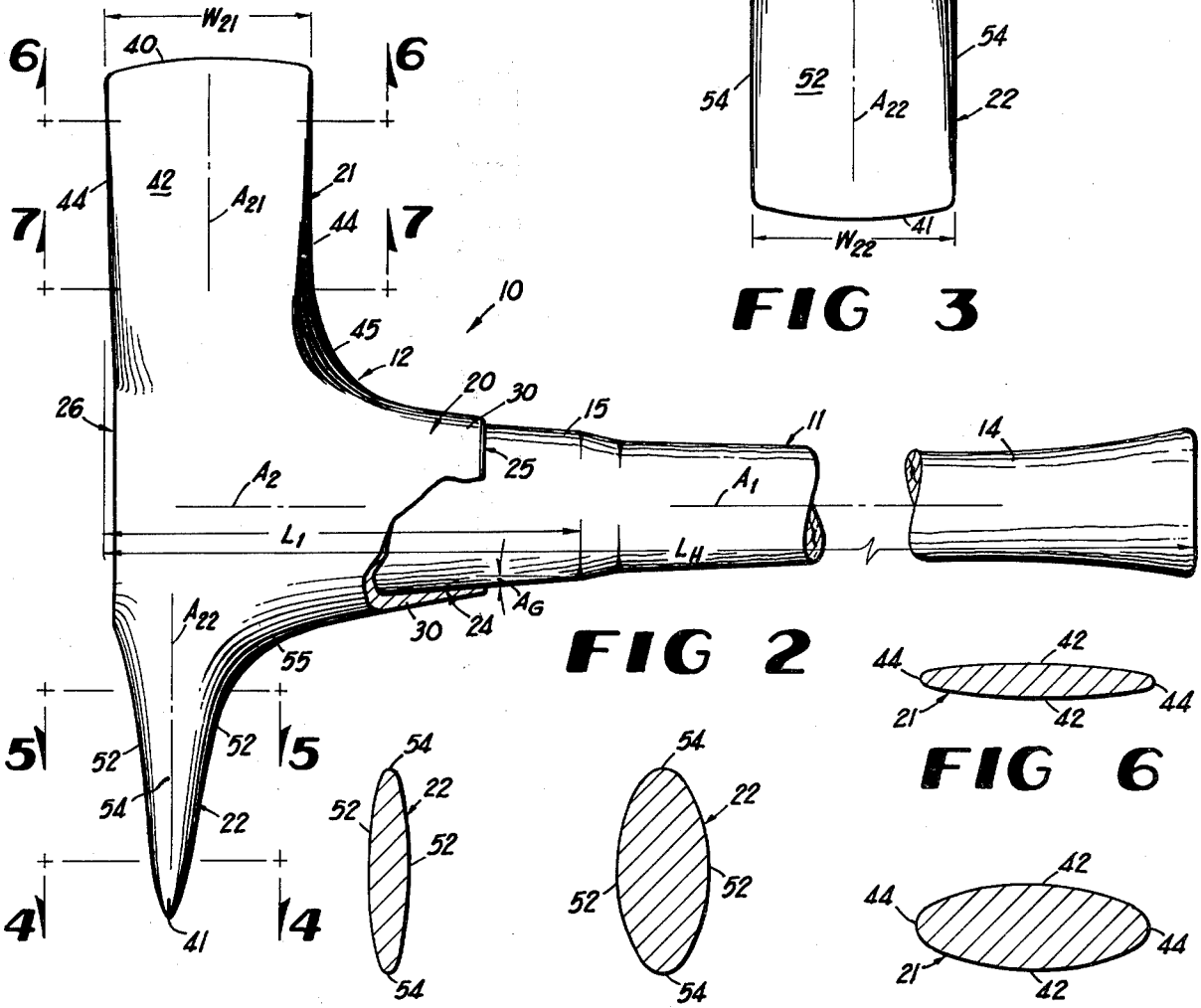
FIG 2
FIG 6
FIG 4 FIG 5 FIG 7

WOOD SPLITTING IMPLEMENT

BACKGROUND OF THE INVENTION

Firewood has normally been split from tree blocks using conventional axes. Although conventional axes are actually used for different purposes, they are primarily designed for and work best when used for cutting. The broad relatively thin blade on these axes cause the axe to frequently stick in the tree block when splitting is attempted thereby making such axes difficult to use for splitting wood. Moreover, these conventional axes usually are provided with small relatively weak handles which are easily broken when the user attempts to use the handle to dislodge the axe if it is stuck in the tree block or to attempt to twist the axe from side to side to pry the block apart. These conventional axes also are usually provided handle eyes which are thin on the opposed sides thereof so that when a hard object is struck, the handle eye may break or distort in these thin sides. Thus, present axe head designs do not allow for sufficiently strong, yet economically inexpensive, wood handles to be used. Presently available axe replacement handles are also difficult to install in that they require sizing, cutting, and wedging the handle to the head. Also, because most axes are relatively lightweight, it is difficult to obtain sufficient penetration, especially in hardwoods, so split the tree block. Moreover, the user frequently has to change his stance to completely split the block in several directions.

Another problem is that a misplaced swing or a swing with more force than needed frequently caused the handle of the axe to strike the block or another surface causing immediate or eventual broken handles. Short handle life has also been encountered due to splinters which are sometimes sticking out from split block sections impacting handle area just below head to cause rapid errosion of the handle.

Wedges have also been used to split tree blocks into firewood. It is difficult, however, to use the wedge without first starting the split in the tree block with an axe. Another of the problems with using the wedge is that an additional implement is required to drive the wedge into the tree block. Once the wedge is driven into the block, it is difficult to remove until the split is completed thereby frequently requiring multiple wedges to split firewood.

SUMMARY OF THE INVENTION

These and other problems and disadvantages associated with the prior art are overcome by the invention disclosed herein by providing a wood splitting implement that is not prone to stick in the tree block during the splitting operation, which facilitates wood splitting by permitting easy twisting of the splitting blade in the tree block, and which frees the splitting edge for easy removal from the split in the tree block. The head design also absorbs the impact force gradually to reduce the shock transmitted to the user and allows the user to split various pieces of firewood from a tree block without any substantial change in cutting stance or turning the block. Further, protection is provided for the handle to prevent the handle from being broken due to the handle striking the block or another object. Also, the implement head design adds strength to haddle by providing steel backing along a greater portion of the handle length to prevent the handle from being broken from the head as it is being removed from the tree block. The invention further provides for incorporation of a larger handle without sacrificing any splitting requirements and allows for easy handle replacement without the need for wedges or use of tools. The weight of the invention is also sufficient to insure sufficient penetration in the tree block to split it. Further, the cross edged splitting blade may be provided with a catch member which prevents the wood from flying back against the user during splitting.

One embodiment of the invention includes a splitting head carried on an elongate handle. The handle has a head carrying section at one end which tapers inwardly toward the opposite gripping end of the handle. The splitting head has a tubular eye section which has a complimentary tapered handle passage therethrough to engage the head carrying section of the handle to prevent the splitting head from flying off of the handle during use. The distal end of the eye section mounts a pair of opposed splitting blades thereon which are integral with the eye section with one of the splitting blades having a splitting edge generally parallel to the handle axis while the other splitting blade has a splitting edge generally normal to the handle axis. Each of the splitting blades is sufficiently thin adjacent the splitting edge to allow penetration of the splitting blade into the tree block to start the split. Each of the splitting blades flares outwardly toward the inboard end thereof sufficiently to cause the split in the tree block started by the splitting edge to separate sufficiently to free the splitting edge for removal of the splitting blade from the block and also flares outwardly sufficiently to cause the shock of the impact force when the splitting blade bottoms out on the block to be gradually absorbed. Each of the splitting blades is rounded at its opposed edges to facilitate pivoting of the splitting blade from side to side to assist in the splitting operation.

The tubular eye section is longer than the width of the parallel edged splitting blade to provide a skirt about the handle which provides a stronger connection between the splitting head and the handle and also prevents the handle from striking the tree block when the implement is being used. The skirt of the tubular eye section also serves to strengthen the opposed sides of the eye section to protect these sections against breakage or distortion if a hard object is struck. The cross edged splitting blade is slightly narrower than the maximum transverse width of the eye section so that when the parallel edged blade is being used, the cross edged blade will not hang in the tree block if the splitting head enters the block sufficiently so that the cross edged blade lies within the split.

A catch member may be provided which cooperates with the cross edged splitting blade to arrest movement of the piece of wood between the blade and the user to prevent that portion of the wood from being thrown toward the user and thus injury to the user. The catch member is located on the splitting head between the cross edged blade and the user and has a spur which projects outwardly of the eye section toward the cross splitting edge. The spur is located inboard of the cross splitting edge sufficiently for the cross splitting edge to start the split before the spur engages the wood block.

Another embodiment of the invention incorporates a driving head in opposition to the parallel edged splitting blade on the tubular eye section. The driving head is slightly narrower than the maximum transverse width of the eye section so that when the parallel edged splitting blade is used, the driving head will not hang in the tree block if the splitting blade enters the tree block sufficiently so that the driving head enters the split.

These and other features and advantages of the invention disclosed herein will become more clearly understood upon consideration of the following specification and accompanying drawings wherein like characters of reference designate corresponding parts throughout the several views and in which:

BRIEF DESCRIPTION OF THE DRAWINGS

FIG. 1 is a perspective view illustrating the invention in use;

FIG. 2 is a side elevational view of a first embodiment of the invention;

FIG. 3 is a front elevational view of the invention illustrated in FIG. 2;

FIG. 4 is a cross-sectional view of the cross edged splitting blade taken along line 4—4 in FIG. 2;

FIG. 5 is a cross-sectional view of the cross edged splitting blade taken along line 5—5 in FIG. 2;

FIG. 6 is a cross-sectional view of the parallel edged splitting blade taken along line 6—6 in FIG. 2;

FIG. 7 is a cross-sectional view of the parallel edged splitting blade taken along line 7—7 in FIG. 2;

Figure 8:
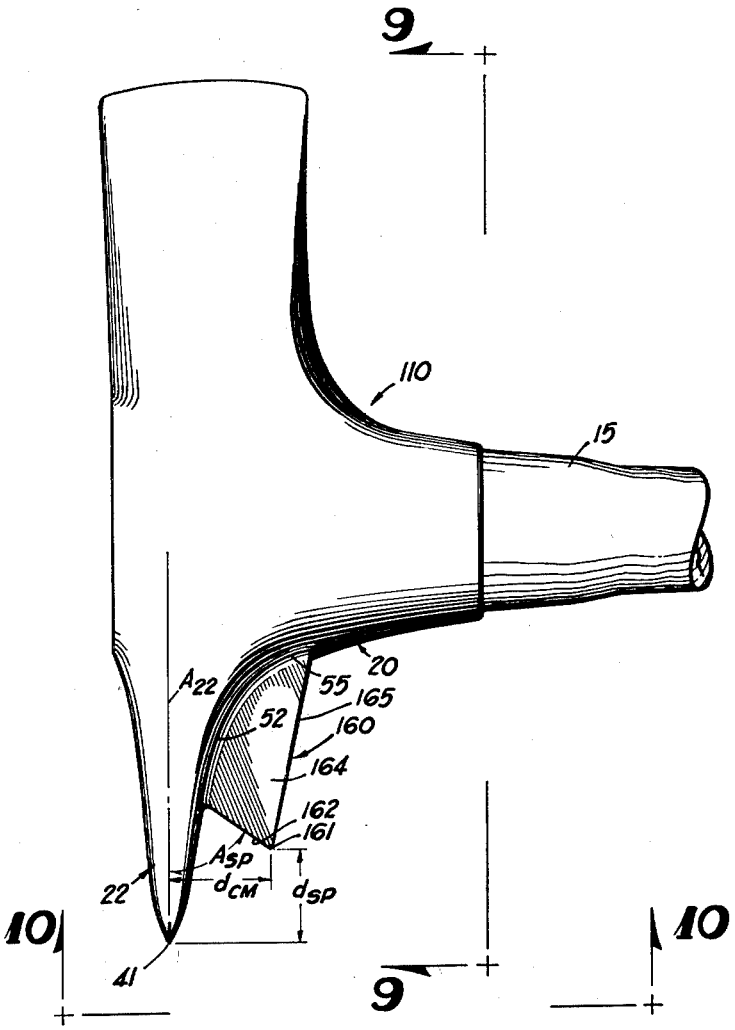
FIG. 8 is a side elevational view of a second embodiment of the invention.

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Referring to FIGS. 1–7, the first embodiment of the invention is designated generally by the numeral 10. The implement 10 includes generally a handle 11 and a splitting head 12. The handle 11 is adapted to be manually gripped so that the head 12 can be swung to split the tree blocks into firewood.

The handle 11 has a longitudinal handle axis $A_1$ with a gripping section 14 at the near end thereof and a head carrying section 15 at the distal end thereof, both of which are centered on the axis $A_1$. The gripping section 14 has a first generally elliptical transverse cross-sectional shape while the head carrying section 15 has a second generally elliptical transverse cross-sectional shape. The head carrying section 15 tapers outwardly from its near end to its distal end at an included angle $A_G$ as best seen in FIG. 2. It will further be noted that the handle 11 has a length $L_H$ and the head carrying section 15 has a length $L_1$ as will become more apparent.

The splitting head 12 has a head central axis $A_2$ with a tubular eye section 20 carried by the head carrying section 15 of the handle 11, a first parallel edged splitting blade 21 integral with and extending outwardly from one side of the eye section 20 and a second cross edged splitting blade 22 integral with and extending outwardly from the opposite side of the eye section 20. The eye section 20 has a seamless side wall 30 which increases in thickness from the near end 25 of head 12 facing toward the gripping section 14 on handle 11 to its distal end 26 facing away from gripping section 14. The side wall 30 thus defines a handle receiving passage 24 through the eye section 20 centered on head axis $A_2$ and tapering outwardly from the near end 25 to distal end 26 of head 12 complimentarily to the head carrying section 15 on handle 11. Thus, it will be seen that the head 12 may be slid, onto and off of the head carrying section 15 on handle 11 over the gripping section 14 for removal but is prevented from sliding off of the head carrying section 15 away from the gripping section 14 on the handle 11. As the implement 10 is swung, the head 12 is inherently tightened on the head carrying section 15 of handle 11.

The parallel edged splitting blade 21 and the cross edged splitting blade 22 are integral with opposite sides of the eye section 20 adjacent the distal end thereof and project outwardly therefrom along respective opposed, generally parallel axes $A_{21}$ and $A_{22}$ which both intersect and are perpendicular to the central axis $A_2$ of the head 12. The parallel edged splitting blade 21 defines a splitting edge 40 on the outboard end thereof which is oriented generally parallel to the head axis $A_2$ while the cross edged splitting blade 22 defines a splitting edge 41 on the outboard end thereof which is oriented generally transversely of the head axis $A_2$. The parallel edged blade 21 has opposed side surfaces 42 and opposed edge surfaces 44. The side surfaces 42 are curved both in the direction of the blade axis $A_{21}$ and transversely of axis $A_{21}$. As seen in the plane of FIG. 3, the side surfaces 42 are generally concave in this plane from their outboard ends toward their inboard ends with an increasing slope with respect to the blade axis $A_{21}$. As seen in FIGS. 6 and 7, it will be seen that the surfaces 42 are generally convex in these planes where the radius of curvature decreases from the outboard end of blade 21 toward the inboard end. The opposed edge surfaces 44 are rounded as best seen in FIGS. 6 and 7 with the radius of curvature of these surfaces increasing from the outboard end of blade 21 toward its inboard end. Thus, while the width $W_{21}$ (FIG. 2) of blade 21 remains about the same from its outboard end toward its inboard end, the blade 21 becomes thicker and more circular from its outboard end toward its inboard end. The near edge surface 44 on blade 21 also is integrally joined to the eye section 20 through a concave fillet 45 as seen in FIG. 2.

Because the side surfaces 42 on blade 21, as viewed in the plane normal to the splitting edge 40 and parallel to blade axis $A_{21}$ in FIG. 3, are concave with an increasing slope from the inboard to outboard ends of the blade 21, the blade 21 is sufficiently thin adjacent the splitting edge 40 to penetrate the tree block and start the split. After the split has started, the outwardly flaring side surfaces 42 engage the tree block within the split to transfer the primary splitting forces making the split from the splitting edge 40 to the side surfaces 42. This frees the splitting edge 40 to facilitate removal of the splitting blade 21 from the tree block. As the splitting blade 21 continues to penetrate the tree block the decreasing slope of the side surfaces 42 on blade 21 causes the penetrating force to be gradually absorbed by the side surfaces 42 and slow the penetrating movement of the blade 21. The side surfaces 42 smoothly join with the outside of the eye section 20 so that the eye section 20 may enter the split in the tree block.

Where the handle 11 has not entered the split in the tree block, the rounded edge surfaces 44 permit the handle 11 to be forced from side to side to rotate the blade 21 in the split in the tree block about the blade axis $A_{21}$. This motion serves to further open the split in the tree block.

The cross edged blade 22 has opposed side surfaces 52 and opposed edge surfaces 54 similar to blade 21. The side surfaces 52 are curved both in the direction of the blade axis $A_{22}$ and transversely of axis $A_{22}$. As seen in the plane of FIG. 2, the side surfaces 52 are generally concave in this plane from their outboard ends toward their inboard ends with an increasing slope with respect to the blade axis $A_{22}$. As seen in FIGS. 4 and 5, it will be seen that the surfaces 52 are generally convex in these planes where the radius of curvature decreases from the outboard end of blade 22 toward the inboard end. The opposed edge surfaces 54 are rounded as best seen in FIGS. 4 and 5 with the radius of curvature of these surfaces increasing from the outboard end of blade 22 toward its inboard end. Thus, while the width $W_{22}$ (FIG. 3) of blade 21 remains about the same from its outboard end toward its inboard end, the blade 22 becomes thicker and more circular from it outboard end toward its inboard end. The near side surface 52 on blade 22 is also integrally joined to the eye section 20 through a concave fillet 55 as seen in FIG. 2. It will also be noted that the width $W_{22}$ of the cross edged blade 22 is slightly less than the maximum transverse width $W_{20}$ of the eye section 20 as seen in FIG. 3.

The concavity of side surfaces 52 when viewed in the plane of FIG. 2 operates similarly to surfaces 42 on blade 21 to permit easy penetration of the tree block, to transfer the primary splitting forces from the splitting edge 41 to the side surfaces 52, and to gradually absorb the penetrating force of the head 12. The fillet 55 serves to absorb any penetrating force not absorbed by side surfaces 52 to stop the penetration of blade 22 into the tree block. The rounded edge surfaces 54 permit the blade 22 to be rotated about the blade axis $A_{22}$ to further open the split similarly to blade 21.

SECOND EMBODIMENT

Figure 9:
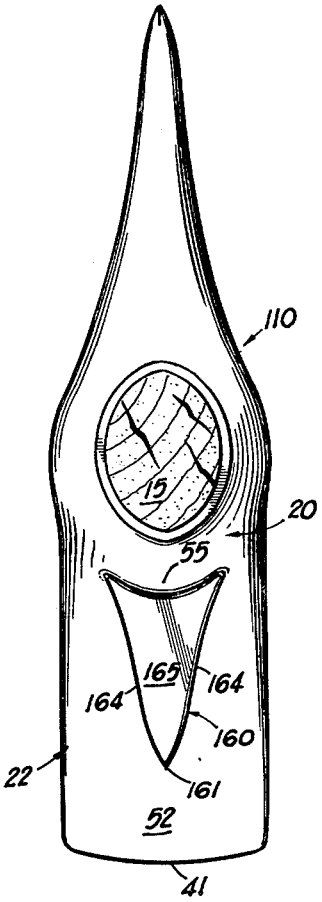
FIG. 9 is a rear view of the second embodiment of the invention taken along line 9—9 in FIG. 8.
Figure 10:
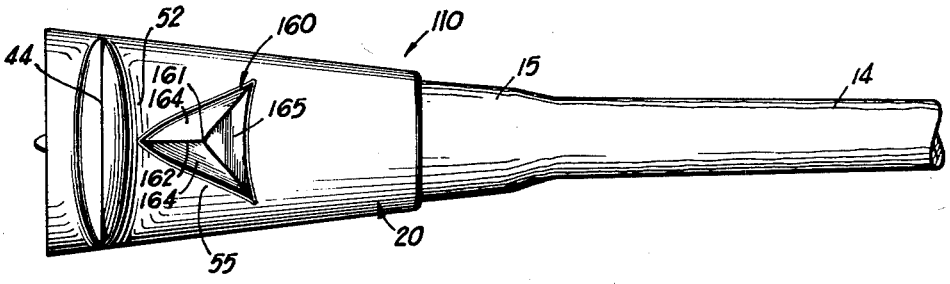
FIG. 10 is an end blade view of the second embodiment of the invention taken along line 10—10 in FIG. 8.

The second embodiment of the invention is seen in FIGS. 8–10 and is a modification of the first embodiment thereof designated generally by the numeral 110. Those components of the implement 110 common to implement 10 have the same reference numbers applied thereto.

The implement 110 has been modified by the addition of a catch member 160 thereto which cooperates with the cross edged splitting blade 22 to prevent that portion of the tree block between the cross edged splitting blade 22 and the user from being thrown toward the user when splitting with the cross edged splitting blade. The catch member 160 as best seen in FIGS. 8–10 is mounted on and integral with the eye section 20, the cross edged splitting blade 22, and fillet 55. The catch member 160 includes a spur point 161 which is located from the blade axis $A_{22}$ toward the user a distance $d_{CM}$ and is located inboard of the splitting edge 41 on the splitting blade 22 a distance $d_{SP}$. A penetrating edge 162 connects the spur point 161 with the near side surface 52 of the cross edged splitting blade 22 as best seen in FIG. 8. It will be noted that the penetrating edge 162 angles inwardly toward the blade axis $A_{22}$ at an included angle $A_{SP}$ of about 35°. It will also be noted that the catch member 160 has a triangular cross sectional shape in the plane of FIG. 10 as well as in the plane of FIG. 9. Thus, it will be seen that the catch member 160 defines a pair of side surfaces 164 which angle away from each other from the penetrating edge 162 toward the eye section 20 as best seen in FIG. 9. The catch member 160 also defines a near edge surface 165 which angles away from the blade axis $A_{22}$ toward the eye section 20 as best seen in FIG. 8.

The distance $d_{SP}$ is selected so that the cross edged splitting blade 22 can sufficiently penetrate the tree blade to start the split therein before the spur point 161 engages that portion of the tree block between the blade 22 and the user. The distance $d_{CM}$ is selected so that a sufficient amount of the tree block is provided between the spur point 161 and the splitting blade 22 to allow the spur point 161 to positively grip the tree block. The angle $A_{SP}$ of the penetrating edge 162 tends to positively force the spur point 161 away from the near side surface 52 on the splitting blade 22 so that the spur point 161 will continue to hold that portion of the ree block between the splitting blade 22 and the user in positive contact with the near side surface 52 of the blade 22. Thus, as the splitting blade 22 continues to penetrate the split in the tree block, the spur 161 serves to prevent the near side surface 52 of the blade 22 from throwing the tree block toward the user. The flaring side surfaces 164 on the catch member 160 along with the penetrating edge 162 allow the catch member 160 to penetrate the tree block as the splitting blade 22 further penetrates the split being made in the block.

OPERATION

Figure 13:
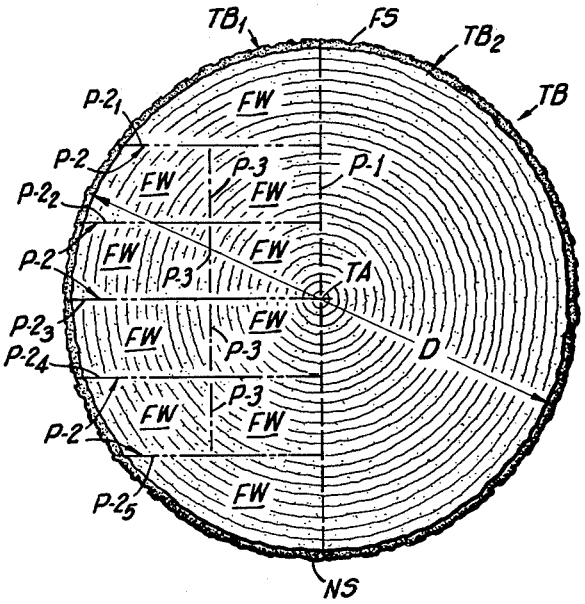

When using the implement 10 or 110 with the splitting head 12 thereon, it is possible to split a tree block TB of wood into smaller pieces of firewood without the operator having to change his stance or rotate the block TB. For illustrating the method of the invention, attention is directed to FIG. 13 which is a schematic view looking down onto the top of a tree block TB which has been set up so that the longitudinal tree axis TA is vertical. With the operator using the parallel edged splitting blade 21, the splitting edge 40 of which is oriented generally parallel to the axis $A_1$ of the handle 11, the operator proceeds to split the block TB along a diametrically extending path P-1 extending from the near side NS of the block TB to the far side FS of the block. If the diameter D of the block TB is sufficiently large, usually 12 inches or more, the separated halves $TB_1$ and $TB_2$ of the block will remain standing. The operator then rotates the implement to use cross edged splitting blade 22, the splitting edge 41 of which is oriented normal to axis $A_1$ of handle 11, and splits one of the halves $TB_1$ along a secondary path P-2$_1$ which is normal to the first path P-1. Usually, the operator starts the splitting of the halves $TB_1$ along the second paths P-2 from the far side FS of the half and works back toward himself so that those pieces of firewood FW which are separated from the half $TB_1$, will be deflected away from the operator. The operator then splits the remaining portion of the half $TB_1$ along another second path P-2$_2$ nearer himself with the cross edged splitting blade 22 and, if the width of the thusly split portion of the half $TB_1$ is too wide, the operator can rotate the splitting head 12 and use the parallel edged splitting blade 21 to split the thusly split piece into smaller pieces of firewood along path P-3 which is generally parallel to the original primary path P-1. Thus, it will be seen that the operator continues to split each of the valves $TB_1$ and $TB_2$ into pieces of firewood FW by splitting the halves along the paths P-2 and P-3.

THIRD EMBODIMENT

Figure 11:
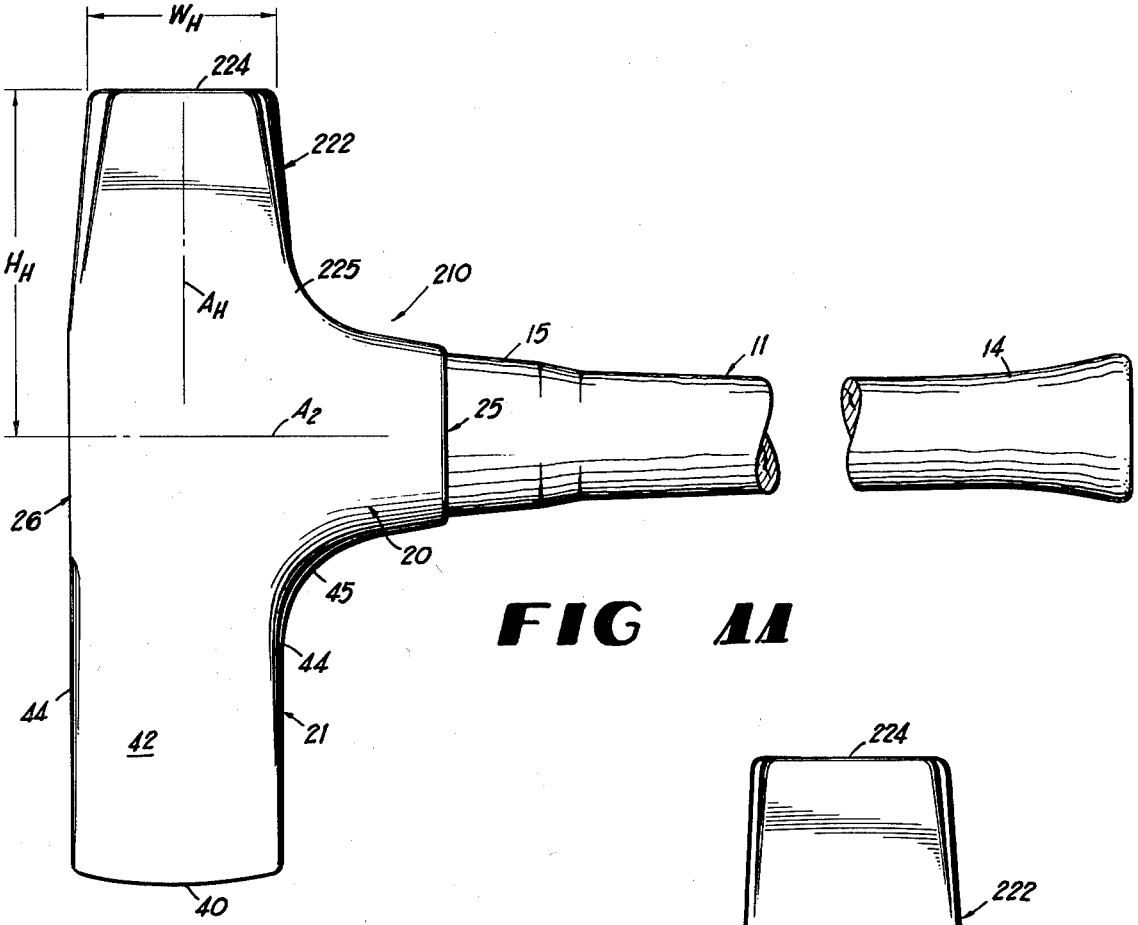
FIG. 11 is a side elevational view of a third embodiment of the invention.
Figure 12:
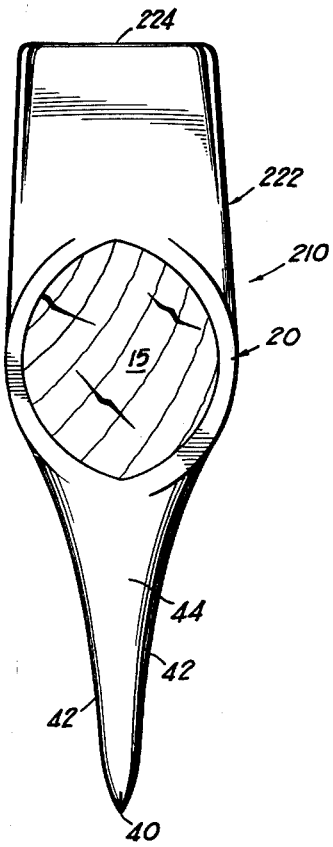
FIG. 12 is a front elevational view of the third embodiment of the invention shown in FIG. 11; and, FIG. 13 is a top view of a tree block illustrating the use of the first and second embodiments of the invention.

Referring to FIGS. 11 and 12, a third embodiment of the invention is illustrated and is designated generally by the numeral 210. Those components of the implement 210 common with the implement 10 have the same numerals applied thereto. The implement 210 has been modified by replacing the cross edged splitting blade of the implement 10 with a driving head 222.

The driving head 222 is centered on a head axis $A_H$ and has a height $H_H$ from the splitting head axis $A_2$. The head 222 has a driving face 224 thereon generally perpendicular to the driving head axis $A_H$ and parallel to the splitting head axis $A_2$ with a working width $W_H$. It will be seen that the driving head 222 tapers inwardly from its inboard end toward its outboard end and has a maximum width at its inboard end which is no greater than the transverse width of the eye section 20 as best seen in FIG. 12. The driving head 222 is joined to the eye section 20 through reinforcing fillets 225 as best seen in FIG. 11. Because the maximum width of the driving head 222 does not exceed the width of the eye section 20, the driving head 222 does not interfere with the splitting of wood blocks using the splitting blade 21.

I claim:

1. A wood splitting implement adapted to be manually swung in operation by an operator to split tree blocks into firewood including:

an elongate handle having a longitudinal handle axis, and including a gripping section at one end to be manuualy gripped by the operator and a head carrying section at the opposite end; and a splitting head mounted on said head carrying section of said handle, said splitting head including a cross edged splitting blade extending outwardly from one side of said handle, said cross edged splitting blade defining a splitting edge on the outboard end thereof oriented generally transversely of said handle axis; and holding means carried by said splitting head and operatively associated with said cross edged splitting blade to engage, at a position spaced from said cross edged splitting blade, that portion of the tree block located between said cross edged splitting blade and the operator after said splitting edge has penetrated the tree block to split same to prevent that portion of the tree block from being thrown toward the operator when the tree block splits.

2. The wood splitting implement of claim 1 wherein said holding means includes a catch member including a spur point thereon located on that side of said cross edged splitting blade facing the operator, located a first distance from said cross edged splitting blade toward the operator, and located a second distance inboard of said splitting edge to allow said splitting edge to penetrate the tree block to start a split before said spur point engages the tree block where said spur point positively grips the tree block until that portion of the tree block between said splitting blade and the operator completely splits to prevent that portion of the tree block between said splitting blade and the operator from being thrown toward the operator when that portion of the tree block between said splitting blade and the operator completely splits to prevent the operator from being hit.

3. The wood splitting implement of claim 2 wherein said catch member further includes a penetrating edge thereon connecting said spur point and said cross edged splitting blade, said penetrating edge angled inwardly toward said handle as it extends to said cross edged splitting blade from said spur point to permit said catch member to penetrate the tree block while said spur point leads said penetrating edge into the tree block and continues to engage the tree block after said penetrating edge has penetrated the tree block so that said cross edged splitting blade can continue to split the tree block after the tree block is engaged by said spur point without that portion of the tree block between said splitting blade and the operator being thrown toward the operator.

4. A wood splitting implement adapted to be manually swung in operation to split tree blocks into firewood comprising an elongate handle (11) having a handle longitudinal axis including a gripping section (14) at the near end thereof and a head carrying section (15) at the distal end thereof, said head carrying section tapering outwardly from said gripping section toward the distal end of said handle; and a splitting head (12) removably mounted on said head carrying section of said handle including:

an eye section (20) defining a handle receiving passage therethrough about a splitting head axis and tapering outwardly from the near end to the distal end of said splitting head complimentary to said head carrying section of said handle so that said splitting head is held in position on said head carrying section of said handle against movement with respect to said handle in a direction away from said gripping section of said handle with said splitting head axis coaxial with said handle axis, said eye section having a prescribed maxium transverse width; and a parallel edged first splitting blade (21) integral with said eye section and extending outwardly therefrom along a first blade axis generally normal to said splitting head axis and radially of said eye section, said parallel edged first splitting blade defining a first splitting edge (40) at the outboard end thereof oriented generally parallel to said splitting head axis, said parallel edged first splitting blade defining opposed first blade side surfaces (42) extending from said first splitting edge to said eye section and opposed first blade edge surfaces (44) joining said first blade side surfaces and extending from said first splitting edge to said eye section, said opposed first blade side surfaces (42) having a concave shape in a first blade longitudinal plane, where said first blade longitudinal plane extends along said first blade axis and is normal to said splitting head axis, with an increasing slope with respect to said first blade axis from said first splitting edge toward said eye section, said first blade side surfaces (42) further being generally convex in shape in a first blade transverse plane, where said first blade transverse plane is parallel to said splitting head axis and normal to said first blade axis, with the radius of curvature of said first blade side surfaces in said first blade transverse plane decreasing in length from the outboard end of said parallel edged first splitting blade at said splitting edge toward its inboard end at said eye section, said first blade edge surfaces (44) being rounded in said first blade transverse plane with a radius of curvature increasing in length from the outboard end of said parallel edged first splitting blade at said splitting edge toward its inboard end at said eye section, said parallel edged first splitting blade (21) having a substantially constant width in a direction generally parallel to said splitting head axis from its outboard end, said parallel edged first splitting blade (21) having a thickness at its inboard end in a direction generally normal to the opposed first blade side surfaces (42) sufficient to force the split formed in the tree block by said parallel edged first splitting blade apart to release said first splitting edge from the tree block; said parallel edged first splitting blade (21) further including a first reinforcing fillet (45) integrally joining that portion of the inboard end of said first splitting blade facing said gripping section on said handle with said eye section, said first reinforcing fillet defining an exterior concave first fillet surface thereon;

a cross edged second splitting blade (22) integral with said eye section (20) and extending outwardly therefrom in opposition to said parallel edged first splitting blade (21) along a second blade axis generally normal to said splitting head axis and parallel to said first blade axis, said cross edged second splitting blade (22) defining a second splitting edge (41) at the outboard end thereof oriented in a direction generally normal to both the direction in which said first splitting edge (40) on said first splitting blade (21) is located and the second blade axis, said cross edged second splitting blade (22) defining opposed second blade side surfaces 52 extending from said second splitting edge to said eye section and opposed second blade edge surfaces (54) joining said second blade side surfaces and extending from said second splitting edge to said eye section, said second blade side surfaces (52) having a concave shape in a second blade longitudinal plane, where the second blade longitudinal plane extends along said second blade axis and said splitting head axis, with an increasing slope with respect to said second blade axis from said second splitting edge toward said eye section, said second blade side surfaces (52) further being generally convex in shape in a second blade transverse plane, where the second blade transverse plane is parallel to said splitting head axis and normal to said second blade axis with the radius of curvature of said second blade side surfaces (52) in said transverse plane decreasing in length from the outboard end of said second splitting blade toward its inboard end, said second blade edge surfaces (54) being rounded in said second blade transverse plane with a radius of curvature increasing in length from the outboard end of said second splitting blade toward its inboard end, said cross edged second splitting blade (22) having a substantially constant width in a direction generally normal to said splitting head axis and said second blade axis from the outboard end of said second splitting blade toward its inboard end with the width narrower than said prescribed maximum transverse width of said eye section (20), said second splitting blade (22) having a thickness at its inboard end in a direction parallel to said splitting head axis and normal to said second blade axis sufficient to force the split formed in the tree block by said cross edged second splitting blade apart to release said second splitting edge from the tree block; said cross edged second splitting blade (22) further including a second reinforcing fillet (55) integrally joining that portion of the inboard end of said second splitting blade facing said gripping section on said handle with said eye section, said reinforcing fillet (55) defining an exterior concave fillet surface thereon; and a catch member (160) including a spur point (161) thereon located on that side of said cross edged second splitting blade (22) facing the operator, said spur point (161) located a first distance from said second splitting blade (22) toward the operator and a second distance inboard of said second splitting edge (41) to allow said cross edged second splitting blade to penetrate the tree block to start a split before said spur point engages the tree block where said spur point positively grips that portion of the tree block between the operator and said second splitting blade to prevent that portion of the tree block between said second splitting blade (22) and the operator from being thrown toward the operator when the tree block splits under the influence of said second splitting blade.

5. The wood splitting implement of claim 4 wherein said catch member (160) further includes a penetrating edge (162) thereon connecting said spur point (161) and said cross edged second splitting blade (22), said penetrating edge (162) angled inwardly toward said handle as it extends to said cross edged second splitting blade from said spur point to permit said catch member to penetrate the tree block while said spur point leads said penetrating edge into the tree block to allow said spur point to continue to engage that portion of the tree block between said second splitting blade and the operator after said penetrating edge has penetrated the tree block so that said cross edged second splitting blade can continue to split the tree block after the tree block is engaged by said spur point yet that portion of the tree block between said cross edged second splitting blade and the operator is held by said spur point to prevent its being thrown toward the operator.

* * * * *